United States Patent [19]

Viel

[11] Patent Number: 5,025,695

[45] Date of Patent: Jun. 25, 1991

[54] STRINGED INSTRUMENT WITH INWARDLY EXTENDING NECK

[76] Inventor: Gerald J. Viel, P. O. Box 144, St. Stephen, New Brunswick, Canada, E3L 2X3

[21] Appl. No.: 428,716

[22] Filed: Oct. 30, 1989

[51] Int. Cl.[5] ..... G10D 3/00

[52] U.S. Cl. ..... 84/293

[58] Field of Search ..... 84/267, 268, 269, 274, 84/275, 291, 292, 293

[56] References Cited

U.S. PATENT DOCUMENTS

| | | | |
|---|---|---|---|
| 715,587 | 12/1902 | Kraske | 84/269 |
| 738,811 | 9/1903 | Johnson | 84/268 |
| 1,754,263 | 4/1930 | Claiborne | 84/274 |
| 2,029,135 | 1/1936 | Stanley et al. | 84/267 X |
| 2,449,124 | 9/1948 | Kimmons | 84/267 |
| 2,793,556 | 2/1953 | Maccaferri | 84/267 |
| 3,072,007 | 1/1963 | Burke | 84/267 |
| 3,302,507 | 2/1967 | Fender | 84/267 |
| 3,396,621 | 8/1968 | Dycus | 84/293 |
| 3,439,570 | 4/1969 | Lee | 84/293 |
| 3,699,837 | 10/1972 | Annessa | 84/291 |
| 3,858,480 | 1/1975 | Schneider et al. | 84/267 X |
| 4,169,402 | 10/1979 | Wood | 84/291 |

*Primary Examiner*—Brian W. Brown

*Attorney, Agent, or Firm*—Rogers, Bereskin & Parr

[57] ABSTRACT

An acoustic stringed musical instrument is provided having a neck which extends inwardly at least to the bridge, acoustically communicating with the top near the bridge. Means are provided to anchor the strings at the lower end of the neck as well as its upper end such that the compressive forces created by the tightened strings are carried substantially completely by the neck alone, leaving the top substantially free of such stresses. Bracing of the top can thus be minimized, and the top can be made of optimum thinness for acoustic quality.

15 Claims, 4 Drawing Sheets

10
40
20
41
42
43
51
23
26
28
25
50
52
44
53
21
25
23
22
25
27
23
24

STRINGED INSTRUMENT WITH INWARDLY EXTENDING NECK

BACKGROUND OF THE INVENTION

This invention relates to musical instruments, particularly acoustic stringed musical instruments.

The designers and builders of acoustic stringed musical instruments, such as acoustic guitars, have long faced a dilemma of trying to meet two competing objectives: acoustics and strength. The top or soundboard of the acoustic body must be, on the one hand, sufficiently light and flexible to resonate freely and produce a true tone, and on the other hand, it must also be sufficiently strong to hold the highly tensioned strings, as well as standing up to ordinary handling.

Conventionally, guitar makers have used a thin top material to obtain the acoustic objective, reinforcing it with braces to provide sufficient strength. Historically, the fan bracing configuration attributed to the Spanish guitar maker Torres was used on gut stringed instruments. The "X"-bracing configuration developed by the Martin Company in the mid-19th century has become the standard for over a hundred years, particularly for instruments equipped with steel strings, which exert considerably stronger forces than gut strings. Many variations of top bracing configurations have been tried by guitar makers to obtain an optimum of acoustic characteristics and strength. Generally speaking, better sounding guitars have thinner tops and less bracing, thus sacrificing strength. Such guitars tend to be more fragile and more susceptible to deformation of the top.

Another problem experienced by designers and builders of such instruments arises from the need to join the neck to the body. Considerable care is generally required in designing and constructing the joint, which is typically accomplished with a dove-tailed branch extending rearwardly from the neck which fits into the neck block of the body. Weakening of this joint causes the neck to deflect due to the oblique loading of the strings. In fact, fracture at the neck joint is also a familiar problem with such instruments of conventional construction.

It is an object of the present invention to obviate or mitigate these and other disadvantages of known instruments.

SUMMARY OF INVENTION

In accordance with the present invention, there is provided a stringed musical instrument having a hollow acoustic body, a bridge and a neck. The hollow acoustic body has a top, a back and sides. The neck extends outwardly from the body and terminates at an upper end having upper string anchoring means. The neck also extends inwardly at least as far as the bridge, acoustically communicating with the top near the bridge and terminating at a lower end. The lower end has lower string anchoring means such that in use the compressive forces of the strings are carried substantially by the neck, leaving the top substantially unstressed by such compressive forces.

Preferably, the instrument has a neck that is in close contact with the top substantially along the portion of the neck extending inwardly within the acoustic body. Advantageously, the instrument has a neck that is glued to the top. Most preferably, the instrument further comprises no more than two braces glued to the top. Most advantageously, the instrument further comprises a plate positioned between the neck and the top, opposite the bridge.

It has surprisingly been found that an instrument made in accordance with the present invention has both excellent acoustic characteristics and strength. The revolutionary structure of the present invention substantially eliminates compressive stresses from the top soundboard. The compressive stresses of the strings are carried substantially entirely by the extended neck alone. Thus, bracing of the top can be minimized and the top can be made of an optimum thinness for the best acoustic characteristics. When the strings are plucked, the vibrations are transmitted along the neck extension and to the top. It is believed that the neck extension actually drives the top and that its extra mass helps to improve the sound sustaining properties of the instrument. The joint between the neck and body of the guitar is also free from any oblique loading by the strings. Construction can thus be simpler.

DETAILED DESCRIPTION OF INVENTION

In order that the invention may be more clearly understood, reference will now be made to the accompanying drawings which illustrate preferred embodiments of an instrument of the present invention and in which.

Figure 1:
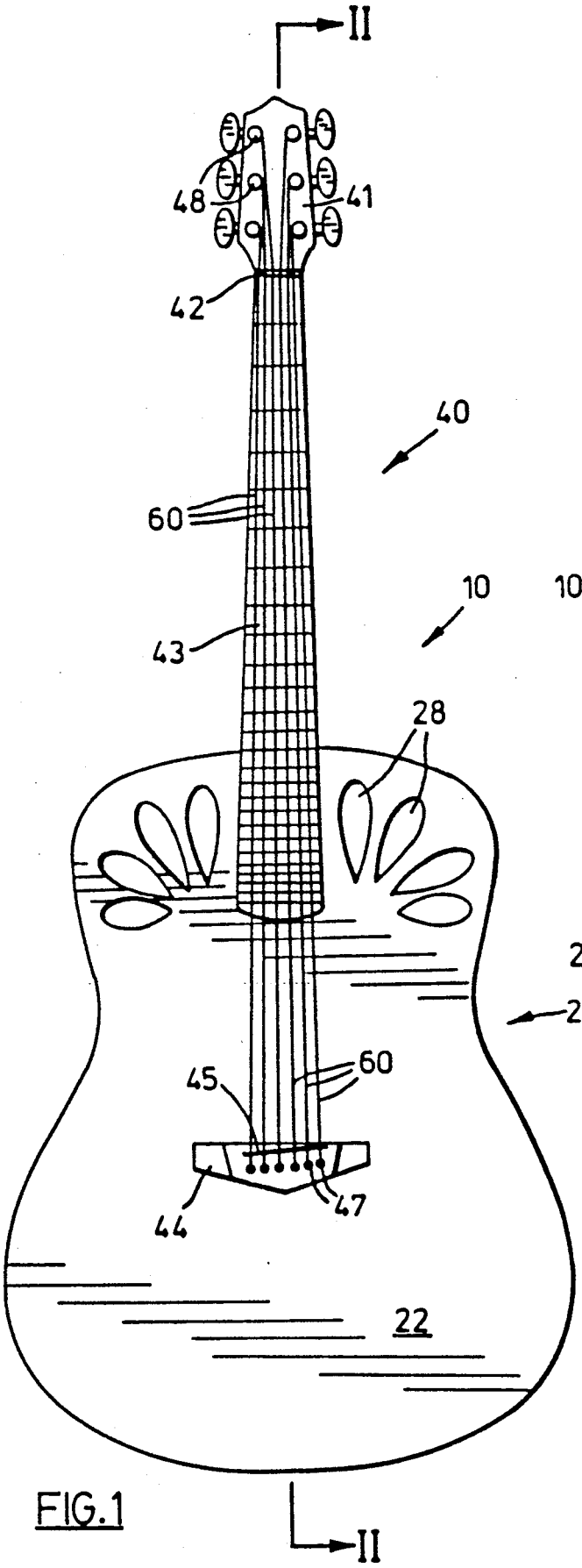
FIG. 1 is a front elevation view of a guitar in accordance with a first embodiment.
Figure 2:
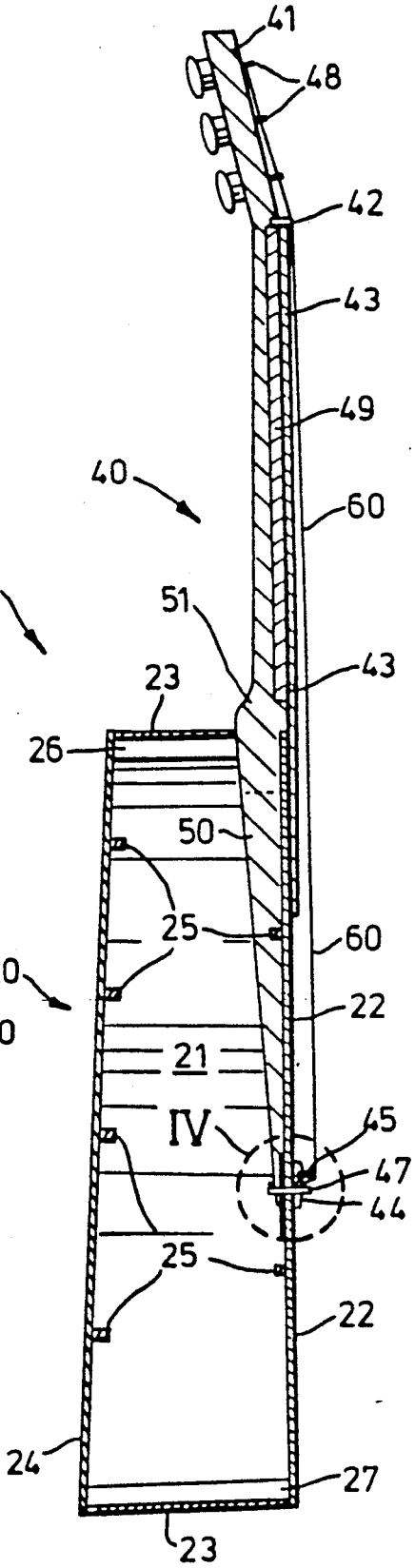
FIG. 2 is a side sectional view of the guitar of FIG. 1 taken along the line II-II.
Figure 3:
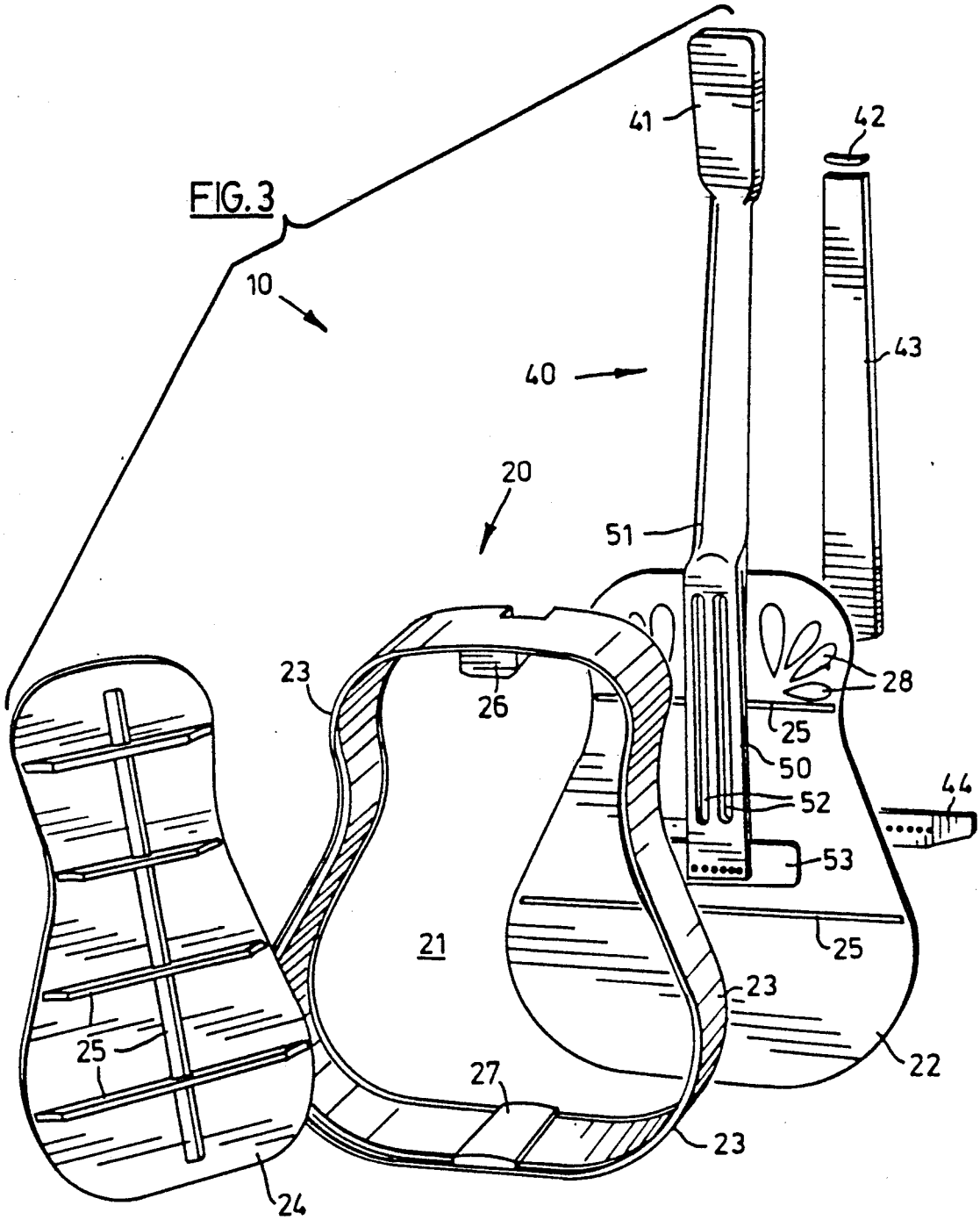
FIG. 3 is a partially exploded rear perspective view of the guitar of FIG. 1, the back having been rotated to expose its inner face.
Figure 4:
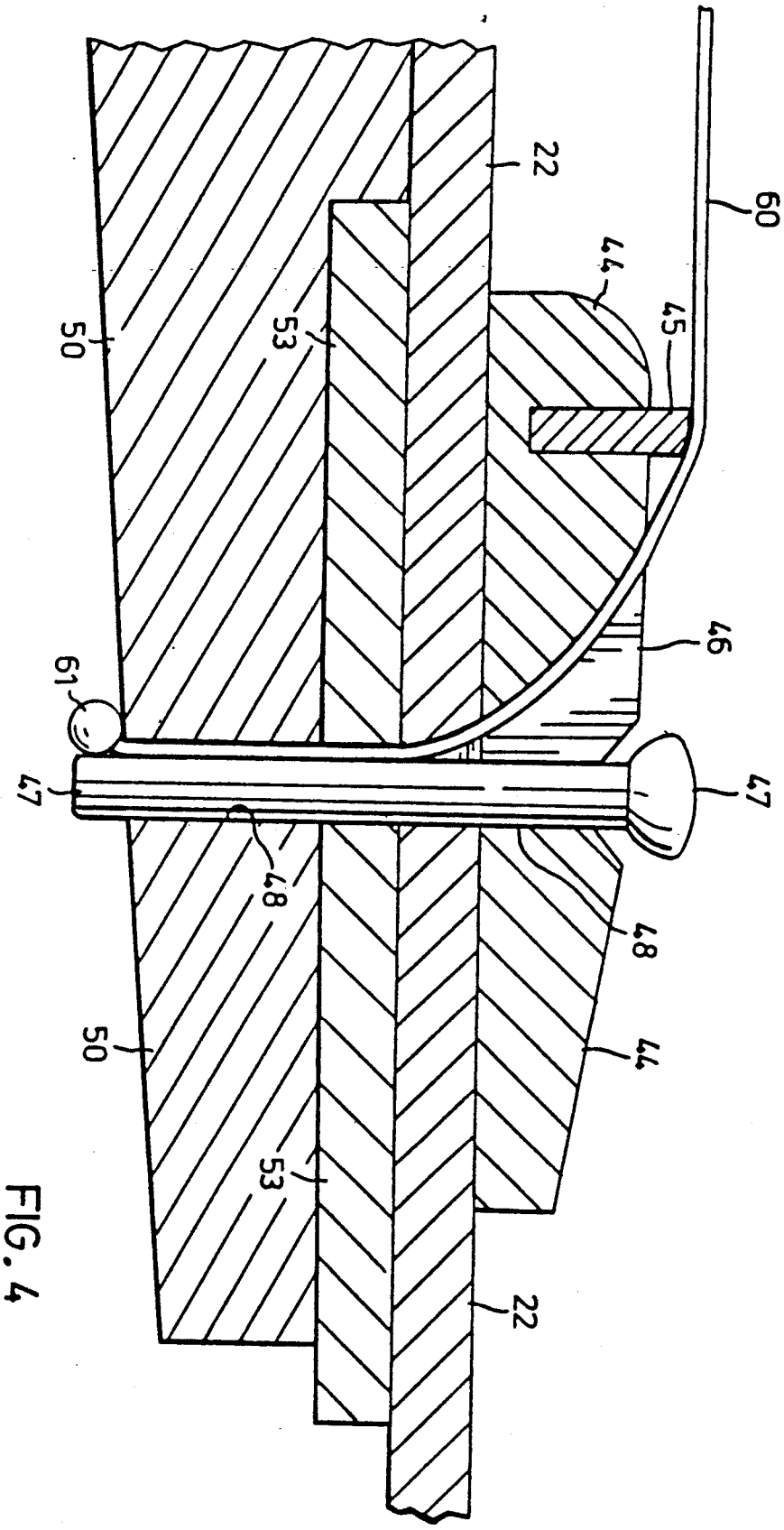
FIG. 4 is an enlarged detailed view of a portion of the guitar of FIG. 2 shown by the circle IV.

In the first embodiment of FIGS. 1–4, the guitar, designated generally by reference character 10, has a body 20 and a neck 40. The body 20 has a top 22, sides 23 and a back 24 which are assembled and glued with a neck block 26 and a tail block 27 in a conventional manner as well known in the art. The tail block 27 is located on the sides 23 at the tail portion of the body 20, opposite the neck block 26 where the neck 40 is secured to the body 20. The body 20 defines internally an acoustic chamber 21. The top 22 has sound holes 28. The neck 40 is secured to the body 20 at neck block 26 with glue and extends outwardly to a head 41 and inwardly to a lower end. The neck 40 includes a thick central portion 51 and an inner extension 50 which is glued to the top 22. The neck extension 50 is tapered from the thick central portion 51 to its lower end and has openings 52. A fingerboard 43 and a nut 42 are glued to the neck 40. A reinforcing bar 49 extends along the outer portion of the neck 40 within a channel, covered by the fingerboard 43. The head 41 includes tuning keys 48 to which strings 60 are anchored at their upper ends and by which the strings may be tightened and tuned.

A bridge 44 is glued to the top 22, approximately in the central region. A saddle 45 projects upwardly from the bridge 44. A plate 53 is glued between the neck extension 50 and the inner face of the top 22, approximately opposite the bridge 44. The bridge 44 has notches 46. The bridge 44, top 22, plate 52 and neck extension 50 all have holes 48 passing therethrough adapted to receive and frictionally retain pegs 47.

The strings 60 have ball ends 61. Each of the strings 60 is anchored at its lower end by inserting its ball end 61 through the appropriate hole 48 corresponding to the proper placement of the string while the peg 47 is removed, and thereafter replacing the peg 47 in the hole 48 such that the ball end 61 of the string 60 is retained. The string 60 extends out through the hole 48 and through a notch 46 in the bridge 44 and is supported by the saddle 45.

Braces 25 are glued along the inner face of both the top 22 and the back 24.

Figure 5:
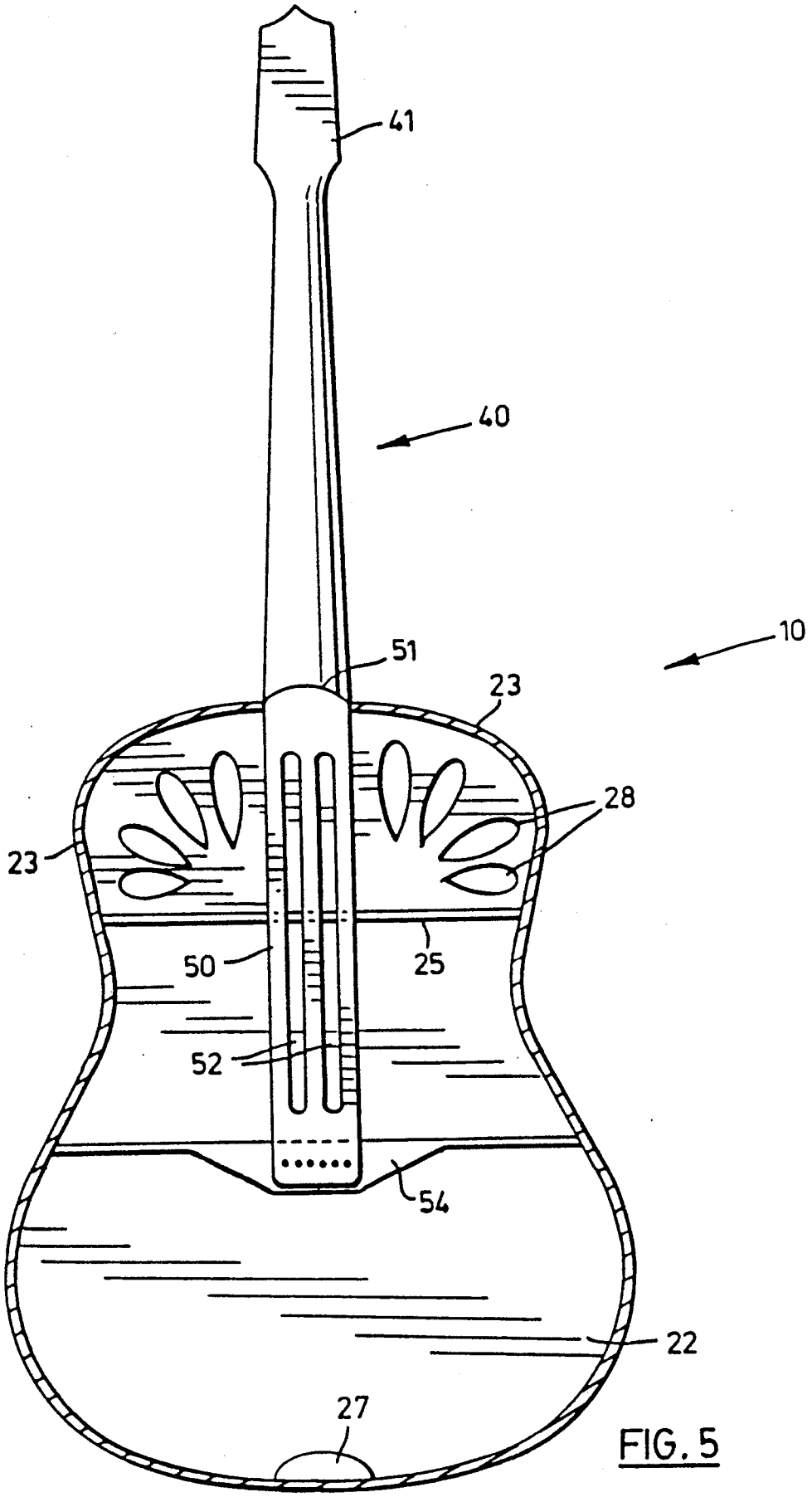
FIG. 5 is a rear sectional view of a guitar according to a second embodiment.

In the second embodiment of FIG. 5, in which like parts are given similar reference characters and whose overall description is not repeated, a bracing plate 54 is used, instead of the plate 53 of the first embodiment. The bracing plate 54 is glued across the top and has a widened central portion opposite the bridge.

Since the strings 60 are attached to the neck 40 at both their upper and lower ends, the neck 40 carries substantially all of the compressive forces of the strings. The neck 40 includes a base portion which constitutes a unitary structural member to carry the compressive forces. The top 22 remains substantially free of the compressive stresses exerted by the strings 60. Thus, the top 22 can be light and substantially unbraced to optimize acoustic characteristics. The braces 25 which are glued to the inner face of the top 22 are provided primarily to inhibit cracks in the top 22 due to moisture changes. The neck extension 50 is glued to the inner face of the top 22. When the strings 60 are caused to vibrate by plucking, the vibrations are transmitted along the neck extension 50 to the top 22. It is believed that the extra mass of the neck extension 50 also helps to improve the sound sustaining properties of the instrument. The neck extension 50 is tapered and includes openings 52 to optimize acoustic characteristics. The location and configuration of the sound holes 28 further promotes a rich and clear tone.

The present invention also substantially eliminates oblique stresses from the strings on the joint between the neck 40 and the body 20. Thus, the conventional dove-tail joint is obviated, and cracking and neck and soundboard deflection are mitigated.

The dimensions and materials for the two preferred embodiments of the invention shown in FIGS. 1-5 are as follows. The overall length of the guitar 10 is 39½ inches. The length of the body 20 is 19 inches. The width of the body 20 at the lower bout is 15¼ inches, at the central bout is 9½ inches and at the upper bout is 11 inches. The sides 23 are tapered such that their width at the neck block 26 is 4½ inches and at the tail block 27 is 5 inches.

The neck 40 has an overall length of approximately 32¾ inches. The length of the outwardly extending portion of the neck 40 is approximately 20¾ inches, including the head 41 which is approximately 6½ inches from the nut 42. The neck extension 50 is approximately 12 inches in length. The thickness of the neck 40 under the nut 42 is approximately ⅝ inches. The thickness of the neck at the thick central portion 51 is approximately 1 inch. The reinforcing bar 49 is a steel tube ⅜ inches square. The thickness of the neck extension 50 at its lower end is approximately ¼ inch. The width of the neck at its lower end is approximately 2¼ inches, and at the nut 42 approximately 1¾ inches. The fingerboard is ¼ inch thick and 18 inches long. The braces are ⅛ inch by ¼ inch in section.

The backs, sides and top are all approximately ⅛ inch thick. The tail block and neck block are approximately 1 inch by 3 inches in cross-section. The plate 53 of the first embodiment and the bracing plate 54 of the second embodiment are ⅛ inch thick.

The top 22 is made of western red cedar. The sides 23 and back 24 are made of rosewood. The neck 40 is made of birch. The fingerboard 43 and the bridge 44 are made of rosewood. The saddle 45 and the pegs 47 are made of plastic. The plate 53 of the first embodiment is made of maple. The nut 42 is made of bone. The braces 25 are made of spruce. The bracing plate 54 of the section embodiment of FIG. 5 is made of maple. The neck block 26 and tail block 27 are made of cherry.

Because the top 22 is glued to the neck 40 along the extension 50, string vibration is carried effectively from the neck 40 to the top 22. Few or no braces 25 are required on the top. This has a further advantage of increasing the effective volume of the acoustic chamber defined by the body and reducing internal surface irregularities. These factors also help to improve volume and tone quality of the instrument.

It will, of course, be appreciated that many other materials could be used. The neck extension need not be glued to the top or even in continuous contact with it. However, this is preferable to enhance resonance and acoustic performance. Other means of anchoring the strings may be used. Different bracing configurations may be used. However, preferably not more than two braces are used on the top. Furthermore, variations in dimensions are possible. Acoustic stringed instruments other than guitars made in accordance with the present invention would have very different dimensions.

I claim:

1. A musical instrument which produces sound by means of vibrating strings, comprising:

a hollow acoustic body having a top, and also having a tail portion apart from said top;

a bridge positioned above said top; and a neck extending outwardly from said body opposite said tail portion, terminating at an upper end having upper string anchoring means, and also extending inwardly to a plane between said bridge and said tail portion, terminating at a lower end having lower string anchoring means, the lower end of said neck being unattached to said tail portion and thus able to vibrate free from restraint thereby, said neck contacting said top near said bridge, such that acoustic vibrations may be transmitted directly from said neck to said top near said bridge, thereby causing said top to resonate, in use, the compressive forces of the strings being carried substantially by said neck, leaving said top substantially unstressed by such compressive forces.

2. An instrument as recited in claim 1, wherein the portion of said neck extending inwardly to said lower end is within said acoustic body.

3. An instrument as recited in claim 2, wherein said neck is in close contact with said top substantially along the portion of said neck extending inwardly within said acoustic body.

4. An instrument as recited in claim 3 wherein said neck is glued to said top.

5. An instrument as recited in claim 4, further comprising no more than two braces glued to said top.

6. An instrument as recited in claim 4, wherein said neck is tapered along its portion extending inwardly within the acoustic body.

7. An instrument as recited in claims 1 or 6 wherein said lower string anchoring means comprises the lower end of said neck and said lower end of said neck has holes adapted to receive and releasably hold the strings.

8. An instrument as recited in claim 5, wherein one of said not more than two braces includes a central widened plate portion which is positioned between said neck and said top opposite said bridge.

9. An instrument as recited in claim 1, wherein the inward extension of said neck terminates near said bridge.

10. An instrument as recited in claims 1, 9, or 3, wherein said neck comprises a unitary structural member.

11. An instrument as recited in claims 1, 9 or 3 further comprising a plate positioned between said neck and said top opposite said bridge.

12. An acoustic guitar, comprising:

a hollow acoustic body having a top, and also having a tail portion apart from the top;

a bridge positioned above the top;

a neck extending outwardly from the body opposite the tail portion, terminating at an upper end having upper string anchoring means and also extending inwardly toward the tail portion, terminating at a lower end located on a plane between the bridge and the tail portion and having lower string anchoring means; and a plurality of strings extending in tension between the upper string anchoring means and the lower string anchoring means, the compressive forces exerted by the strings being carried substantially by the neck, leaving the top substantially unstressed by such compressive forces;

the lower end of the neck being able to vibrate free from direct restraint by the tail portion of the body, and the neck contacting the top near the bridge such that acoustic vibrations may be transmitted directly from the neck to the top.

13. A guitar as recited in claim 12, comprising at least six strings.

14. A guitar as recited in claim 13, comprising not more than six strings.

15. A guitar as recited in claims 12, 13, or 14, wherein the portion of the neck extending inwardly toward the tail is within the acoustic body and glued to the top, and further comprising a brace extending substantially across the body glued to the top and having a central widened plate portion positioned between the neck and the top opposite the bridge.

* * * * *